United States Patent [19]

Roetgerink

[11] 4,242,853

[45] Jan. 6, 1981

[54] METHOD AND APPARATUS FOR ARRANGING A CARRIER MAT ON A NUMBER OF CONTAINERS

[75] Inventor: Johannes A. Roetgerink, Hengelo, Netherlands

[73] Assignee: B.V. Machinefabriek M. Brouwer & Co., Hengelo, Netherlands

[21] Appl. No.: 3,801

[22] Filed: Jan. 16, 1979

[51] Int. Cl.[3] ..... B65B 21/00

[52] U.S. Cl. ..... 53/398; 53/48

[58] Field of Search ..... 53/48, 441, 398, 413, 53/313, 314

[56] References Cited

U.S. PATENT DOCUMENTS

| | | | |
|---|---|---|---|
| 3,285,410 | 11/1966 | Brunsing | 53/480 U X |
| 3,521,737 | 7/1970 | Calvert | 53/48 |
| 3,848,396 | 11/1974 | Schmidt | 53/314 X |
| 3,877,198 | 4/1975 | Vergobbi | 53/48 |
| 3,908,332 | 9/1975 | Ebbinghaus et al. | 53/48 |

*Primary Examiner*—Horace M. Culver

*Attorney, Agent, or Firm*—Eyre, Mann, Lucas & Just

[57] ABSTRACT

An apparatus for arranging a carrier mat of resilient material on a number of arranged moving containers, comprising a conveyor for the containers, a delivery device for the mats and means for positioning the containers or bottles with respect to this delivery device, which latter comprises a first and a second pair of mutually opposite-reciprocating driven slides, the upper face of the second pair being located lower than that of the first pair over a distance corresponding to the thickness of the carrier mat, the slides of the first pair being provided with pressure faces directed aslant toward the containers and the distance between the top of the containers and the bottom of the first pair of slides being smaller than the thickness of the carrier mat.

11 Claims, 5 Drawing Figures

METHOD AND APPARATUS FOR ARRANGING A CARRIER MAT ON A NUMBER OF CONTAINERS

BACKGROUND OF THE INVENTION

The invention relates to a method of arranging a carrier mat of resilient material on a number of ranged moving containers, this carrier mat being provided with apertures for receiving the containers, the apertures being provided with upwardly tapered collars for supporting the containers, according to which the carrier mat is delivered from a store by means of a delivery device, positioned on the containers and then fixed by means of a pressing mechanism.

In the soft-drink industry, for instance, it is more and more customary to interconnect a number of containers or bottles by means of carrier mats or clips. The bottles are then offered for sale in shops in packs of four, six or eight units. For the consumer such "six packs" have the advantage that several bottles can be carried easily, the advantage for the seller being that six bottles are always sold at the same time. Furthermore, it is not necessary to handle heavy crates with filled bottles.

In the method according to the invention, known carrier mats are used which are made of relatively rigid, flexible material and which along the inside edge of the apertures are provided with collars for receiving and supporting the bottles by their necks. In the middle portion two holes are made in which to put thumb and forefinger for carrying the mat with the bottles arranged therein. This type of carrier mats is described in U.S. Pat. Nos. 3,633,962 and 3,261,498.

When the mats are arranged on the bottles, the difficulty occurs of the mats having to be placed in the correct position on the bottles which themselves move forward at high speed. The mats in store must, therefore, be delivered at the right moment. Setting the moment of delivery is, therefore, very critical and a source of trouble.

The invention provides a method according to which the moment of delivery is less critical and the mat is placed on the containers fully controlled.

SUMMARY OF THE INVENTION

According to the invention, these objects are attained in that, for being positioned on the containers, such carrier mat is delivered from the store before the containers are located under the apertures, so that the mat is put on the containers with the portions located between the apertures, whilst the mat is then held and pressed against the top of the containers under tension, whereafter the mat is released when the containers moving under the mat drop into the apertures such, that the mat will rest on the containers with its collars and is conveyed to the pressure mechanism by these containers.

In this manner the mat may be delivered in the time that the container is located between two consecutive apertures. From the moment of being delivered the mat is held until it has assumed the right position on the bottles.

According to the method, the carrier mat after being delivered from the stock is preferably held and pressed against the containers by the discharging apparatus.

The invention is also incorporated in an apparatus for executing the method, comprising a conveyor for the containers, a store at the discharge side of which an apparatus for the delivery is arranged, means for positioning the bottles with respect to the delivery device, and means for pressing the carrier mat on the containers. In this apparatus the delivery device is made up of a first and a second pair of slides, driven opposite-reciprocatingly, the upper bearing surface of the second pair being located at a distance from that of the first pair corresponding to the thickness of the carrier mat, which pairs at turns impede the passage of the mats from the store, the slides of the first pair being provided with a pressure surface directed aslant toward the containers, the distance between the top of the containers and the bottom of the first pair of slides being smaller than the thickness of the carrier mat.

Thus, the pair of slides provided with the pressure surface has a double function, namely supporting the mats left in the store and pressing the delivered mat against the top of the containers. Only when the mat is located in its correct position on the container, i.e. when the mat rests on the top of the containers by the collars, provided in the apertures, the mat is released from the slides and can be carried along by the containers.

In an embodiment of the invention, the pressure mechanism is made up of at least one skate which is provided with a guide surface co-operating with the carrier mat, the distance between the guide surface and the chain conveyor diminishing in the direction of motion of the latter.

SURVEY OF THE DRAWINGS

DESCRIPTION OF PREFERRED EMBODIMENTS

Figure 1:
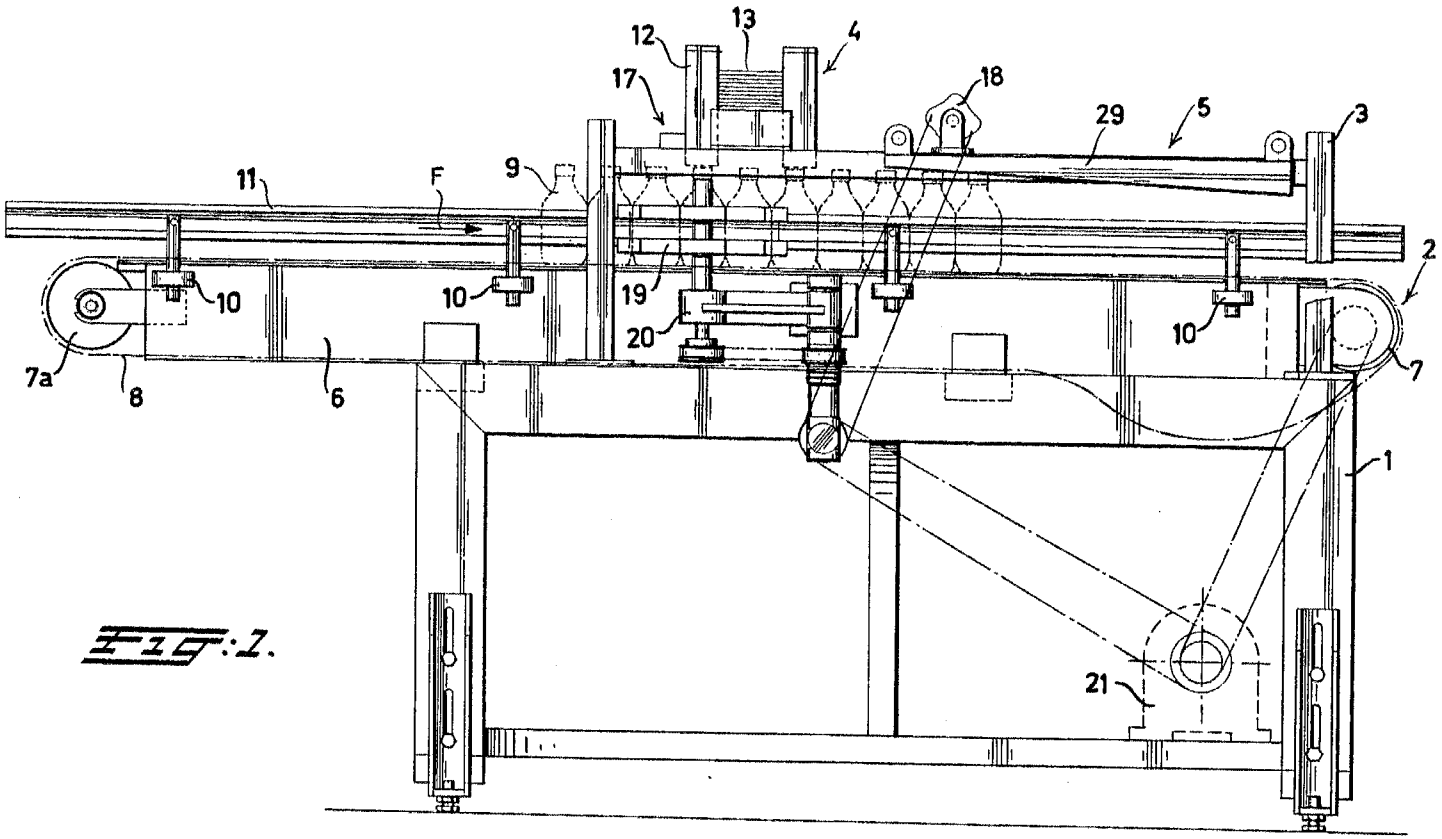
FIG. 1 is a schematic side elevation of the apparatus according to the invention.

The apparatus illustrated comprises a base frame 1 which bears a conveyor 2. On the base frame there is mounted an upper frame 3 which forms a portal across the conveyor. On the upper frame there are mounted consecutively a store 4 and pressure mechanism 5.

The conveyor 2 is made up of an oblong frame 6 with, at both ends, a chain wheel 7, *7a* on which an endless bottle chain 8 is arranged. The chain 8 rests on the top of the frame 6 and is intended to convey containers or bottles 9. On both sides of the frame there are fixed a number of supports 10 which bear a guide 11 to bottles.

The discharging side of the store 4 is located vertically above the chain 8. This store comprises a housing 12 in which carrier mats 13 are stacked horizontally and, as shown clearly in FIG. 4, the mats 13 are provided with six identical apertures 14 for receiving bottles. Along the inner circumference each aperture is provided with split collars 15 projecting inwardly for supporting the bottles. In the middle of the mat there are arranged two apertures 16 for transporting the mat with the bottles 9 arranged therein. On the bottom of the housing 12 is arranged a device 17 for delivering the carrier mats one at a time and positioning them on the bottles. The delivery device is driven by a cam 18. On both sides of the frame 6 are arranged star wheels 19 which are provided with recesses corresponding to the circumference of the bottles and which serve for positioning the bottles with respect to the store and the delivery device. The star wheels are supported pivotally in the end of an arm 20 which is fixed pivotally to the frame 6. The star wheels 19 as well as the cam 18 and the chain wheel 7 are driven by an electric motor 21.

Figure 2:
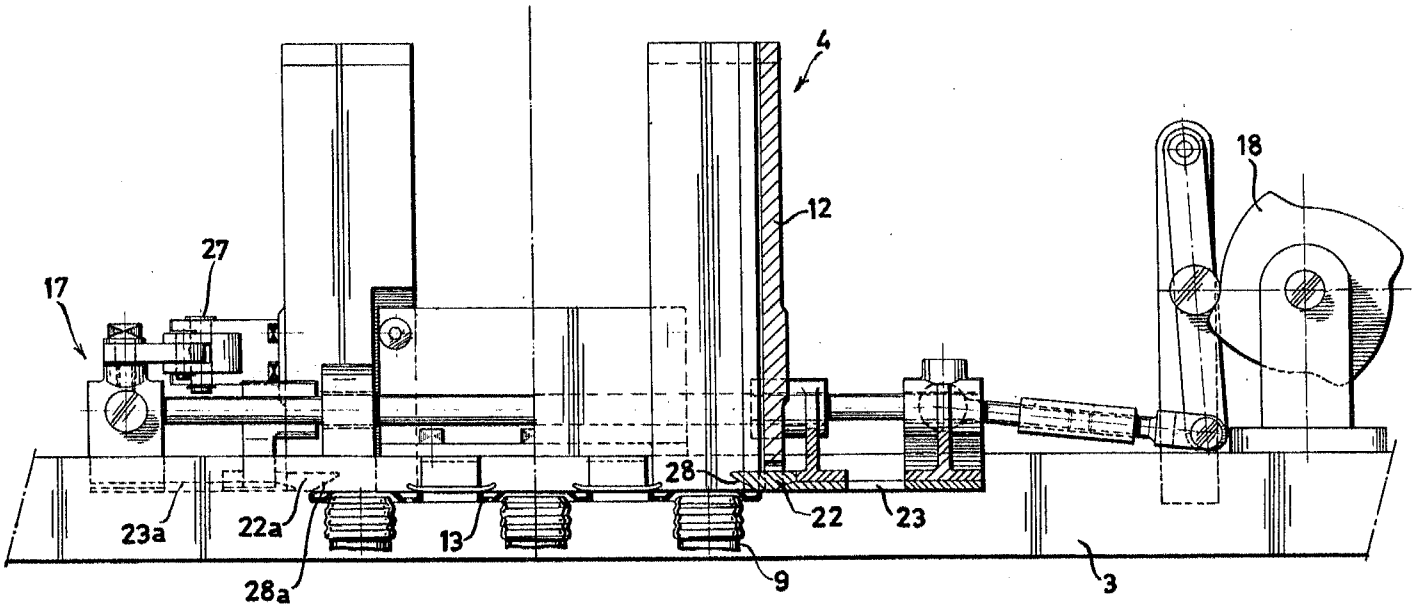
FIG. 2 shows a partial section of the store with delivery device.

As illustrated in FIG. 2, the delivery device 17 comprises two pairs of slides 22, 22*a* and 23, 23*a*, which are connected on both sides of the housing 12 with slidably supported rods 24, 25. The two rods are interconnected via a lever 26 which is pivotal around a fixed hinge-point 27. Via a system of rods one of the rods 24 is brought into a reciprocating movement by means of the cam 18, while the other rod 25 connected therewith always carries out a reciprocating movement in an opposite direction.

Figure 3:
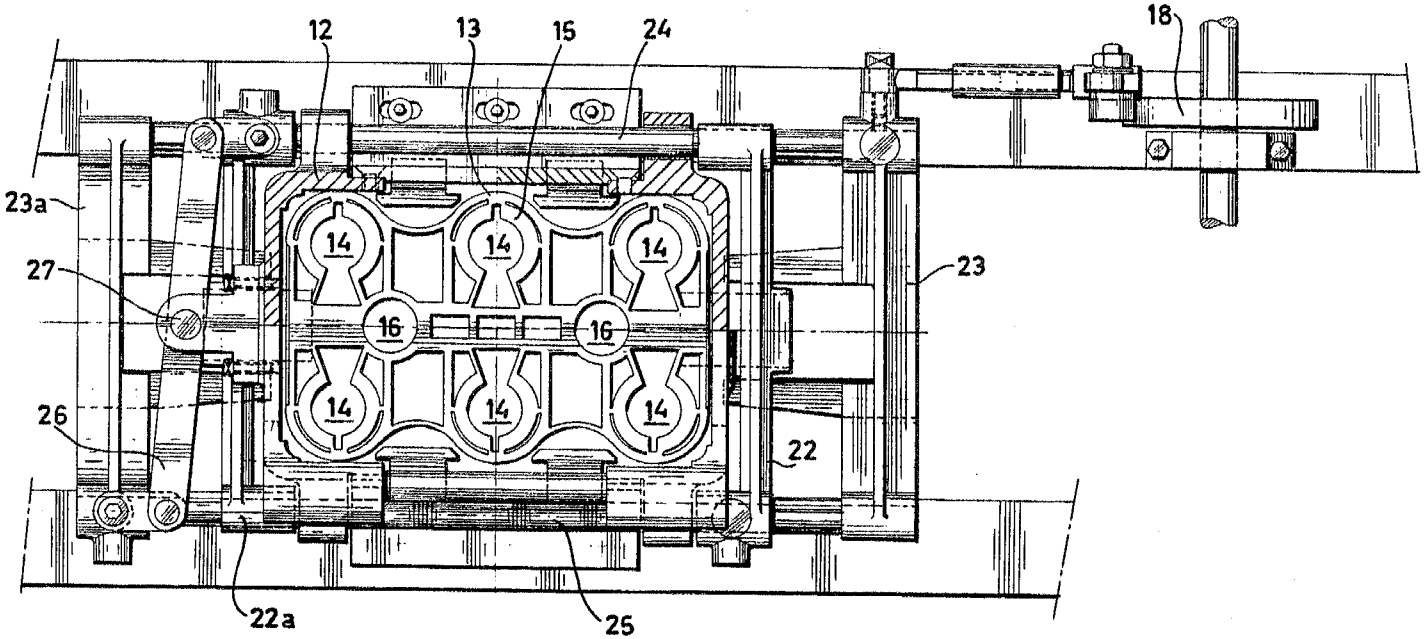
FIG. 3 shows a top view of the detail according to FIG. 2.

As shown in FIG. 3, the slides 22*a* and 23 are connected to the rod 24 and the slides 22 and 23*a* are connected to the rod 25. Thus the slides of each pair move firstly toward and then away from each other. The motion of the two pairs is opposite, i.e. that if the slides of the first pair move toward each other the slides of the second pair move away from each other. The upper surface of the first pair of slides 22, 22*a* is located at a distance from the upper surface of the second pair of slides 23, 23*a* which is about equal to the thickness of the carrier mat. The lower sides of the two pairs of slides are located in one horizontal plane (see FIG. 2).

FIG. 2 also shows that the slides of each pair are arranged at both sides of the housing 12. In their most outward position the slides let the delivery aperture of the store free, while in their most inward position they impede the passage of the mats through the delivery aperture. The slides 22, 22*a* of the first pair are arranged in the middle of the sides of the housing 12 transversely on the direction of motion of the bottles. The sides 23,23*a* of the second pair each consist of two long, narrow fingers located on both sides of the slides of the first pair. Moreover, at their free end the slides 22, 22*a* of the first pair are provided with a slanting pressure surface which is directed downwardly.

Figure 5:
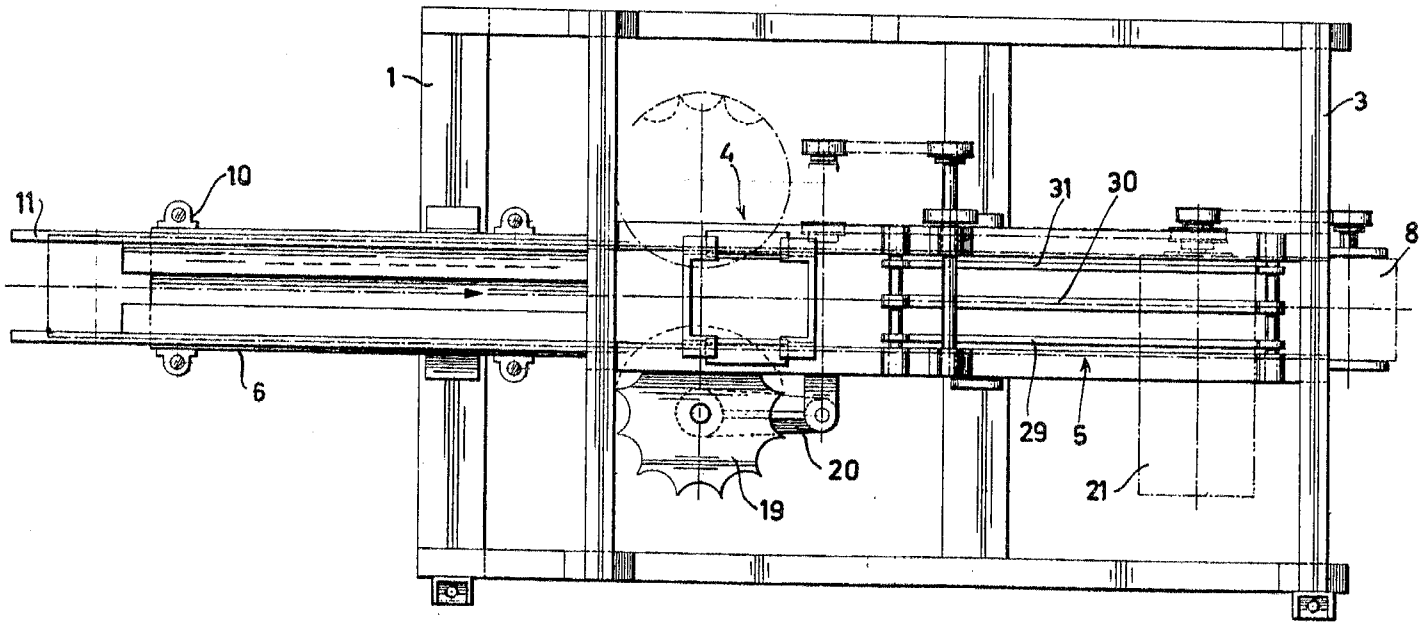
FIG. 5 shows a top view of the apparatus according to FIG. 1.

The pressure device 5 consists out of three parallel skates 29, 30, and 31 which are mounted on the frame 3 (see FIG. 5). These skates are located with their longitudinal direction in the direction of motion of the bottle chain 8 and are provided with a guiding surface on the side facing the chain. The distance between the guiding surface and the bottle chain 8 diminishes in the direction of motion of the chain. The mutual distance of the skates is adjustable.

The apparatus operates as follows:

The bottles or containers 9 are supplied two by two and moved forward by means of the bottle chain 8 and the containers are placed in their correct position with respect to the delivery device 17, by means of the star wheels 19. The star wheels can pivot outwardly with the arm 20 so as to adapt to the thickness of the bottles. The delivery device delivers a carrier mat which is positioned on the containers in a manner to be described hereinafter. Then the mat is conveyed by the containers to a pressure device 5 where the mat, by means of the skates 29, 30 and 31, is pressed over the bottles, so that the collars drop behind the closing of the bottles and the mat is securely locked. The skates are then positioned in such a way that the middlemost skate 30 engages the mat between the bottles and that the other skates 29, 31 engage the mat on the outside of the bottles.

Figure 4:
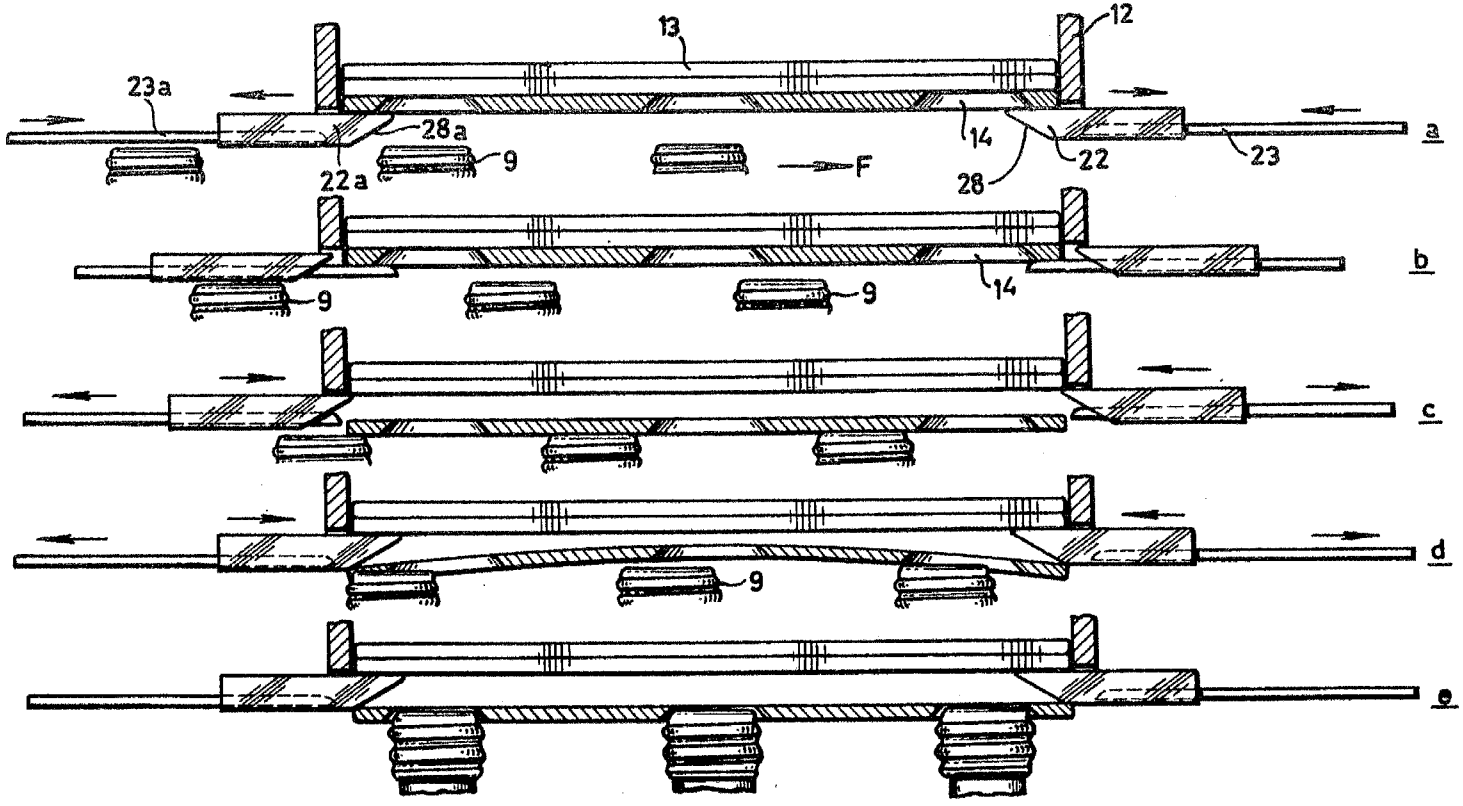
FIG. 4 shows a section of the delivery device with the consecutive steps of the method according to the invention.

In FIG. 4 is illustrated in the consecutive steps a-e how the delivery and positioning of a carrier mat on a number of containers or bottles is effected. FIG. 4*a* shows schematically a number of carrier mats 13 stacked in the housing 12, which mats rest on the slides 22, 22*a* of the first pair directed toward each other. Below the slides there is indicated the top of three bottles 9 which are moved forward in the direction of the arrow F. The slides 22, 22*a* move away from each other, while at the same time the slides 23, 23*a* of the second pair move toward each other. In this manner, the entire stack of carrier mats will rest on the slides 23, 23*a*, as a result of which the stack will be lowered over a distance corresponding to the difference of height between the faces of the two pairs of slides. This position is illustrated in FIG. 4*b*. The second pair of slides then again moves away from each other, while the first pair of slides moves inwardly, FIG. 4 shows the moment at which the undermost carrier mat drops between the slides of the second pair moving outwardly, while the carrier mats remaining in the store are held up by the slides of the first pair which move inwardly again. From FIG. 4*c* can also be seen clearly that the carrier mat just delivered rests on the containers with the parts located between the apertures 14, while the carrier mat is locked between the slides of the delivery device. The slides 22, 22*a* of the first pair which move further inwardly then press the mat resiliently against the top of the containers with their slanting pressure faces 28 resp. 28*a*. In this manner the carrier mat made of a rigid, flexible material is pressed downwardly on the containers by the slides of the first pair (see FIG. 4*d*). The bottles slide under the locked mat till the containers 9 drop with their top into the respective apertures 14. Thus, the carrier mat falls downwardly over a slight distance as a result of which it gets free from the slides 22,22*a*. The latter position is illustrated in FIG. 4*a*, from which position the mat is carried on by the bottles to the pressure deivce where the mat is finally pressed onto the bottles.

What is claimed:

1. A method for applying a carrier mat on a plurality of moving ranged containers, said carrier mat having a corresponding plurality of apertures for receiving the tops of said plurality of said ranged containers, comprising the steps of:

(a) conveying said plurality of ranged containers under a carrier mat delivery device;

(b) positioning said carrier mat in said delivery device for dropping onto said containers as said containers are conveyed past said delivery device;

(c) dropping said carrier mat from said delivery device so that portions of said carrier mat other than said plurality of apertures rest on the tops of said containers;

(d) holding said carrier mat in pressure abutment against said tops of the containers after dropping of said carrier mat while said containers continue to move in relation to said carrier mat;

(e) releasing said mat when said apertures of said mat coincide with the tops of said containers, whereby said mat drops to rest in position wherein said tops of said containers extend through said apertures; and (f) pressing said carrier mat into pressure engagement with the top portions of said containers.

2. The method of claim 1 wherein the step of pressing said carrier mat comprises the step of guiding said moving ranged containers having said carrier mat arranged thereon under a guide face, said guide face cooperating with said containers to press said carrier mat against the top of said containers.

3. Apparatus for applying a carrier mat to a plurality of moving ranged containers, said carrier mat being provided with a corresponding plurality of apertures for receiving and supporting said containers by pressure engagement about the tops thereof, comprising:

(a) conveyer for moving said ranged containers;

(b) a delivery device;

(c) said conveyer being adapted to continuously move said plurality of ranged containers under and past said delivery device; and (d) said delivery device comprising:

(i) means for positioning said carrier mat above said plurality of ranged containers prior to a coincidence of said containers with said apertures of said carrier mat, said carrier mat being positioned substantially in a horizontal position;

(ii) means for releasing said carrier mat onto said containers at such time that portions of said carrier mat between said apertures will rest on said tops of said containers;

(iii) means for holding said carrier mat in pressure abutment with said tops of said ranged containers while said containers continue to move relative to said carrier mat, said means for holding being operative to release said carrier mat when said tops coincide with said apertures whereby said carrier mat drops into engagement with said ranged containers, said tops of said plurality of ranged containers extending through said corresponding plurality of apertures.

4. The apparatus of claim 3 further comprising means for pressing said carrier mat to fix said carrier mat against the tops of said containers.

5. The apparatus of claim 4 wherein the pressure mechanism comprises at least one skate having a guide face incooperating abutment with the carrier mat, the distance between said guide face and said conveyer diminishing in the direction of motion of the conveyer.

6. The apparatus of claim 5 wherein a plurality of guide skates engage the carrier mat on both sides of each containers.

7. The apparatus of claim 6 wherein the mutual distance between said plurality of said skates is adjustable.

8. The apparatus of claim 3 further comprising means for storing and sequentially positioning a plurality of said carrier mats on successive pluralities of said ranged containers.

9. The apparatus of claim 8 wherein said means for sequentially positioning and said means for holding comprise:

(a) a first and second pair of opposite-reciprocating driven slides;

(b) the upper face of said second pair being located lower than the upper face of said first pair by a distance corresponding to the thickness of the carrier mat;

(c) said first and second pairs impeding alternately the passage of said carrier mats from top to bottom;

(d) said first pair of slides being provided with pressure faces, said pressure faces directed on a slant toward the containers; and (e) the distance between the top of the containers and the bottom of said first pair of slides being smaller than the thickness of said carrier mat.

10. The apparatus of claim 5 wherein the pressure face is at the free end of each slide.

11. In an apparatus for sequentially applying carrier mats of resilient material onto sequential pluralities of moving ranged containers, said carrier mats being provided with corresponding apertures for receiving said plurality of containers, and said containers having tops for pressure engagement with said apertures of said carrier mat for support of said containers, the improvement comprising:

(a) means for sequentially positioning each of a plurality of said carrier mats above a successive sequence of pluralities of said ranged containers; each carrier mat being positioned substantially horizontally;

(b) means for sequentially dropping each said carrier mat, said carrier mat being dropped at such time that the portion between the apertures is supported by the tops of said containers;

(c) means for holding each of the dropped carrier mats in pressure abutment with said tops of said ranged containers while said ranged containers continue to move relative to the dropped carrier mat; and (d) said means for holding being operative to release the dropped carrier mats when said tops move into coincidence with said apertures whereby said carrier mat drops further into engagement around the corresponding tops of said ranged containers.

* * * * *